US009583289B2

(12) United States Patent
Larcher et al.

(10) Patent No.: US 9,583,289 B2
(45) Date of Patent: Feb. 28, 2017

(54) ELECTRICAL SWITCHING DEVICE

(71) Applicant: SCHNEIDER ELECTRIC INDUSTRIES SAS, Rueil-Malmaison (FR)

(72) Inventors: Patrick Larcher, Echirolles (FR); Patrick Comtois, Saint Ismier (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 15/035,297

(22) PCT Filed: Dec. 8, 2014

(86) PCT No.: PCT/EP2014/076865

§ 371 (c)(1),
(2) Date: May 9, 2016

(87) PCT Pub. No.: WO2015/086517

PCT Pub. Date: Jun. 18, 2015

(65) Prior Publication Data

US 2016/0293367 A1 Oct. 6, 2016

(30) Foreign Application Priority Data

Dec. 9, 2013 (FR) ..... 13 62322

(51) Int. Cl.
*H01H 51/30* (2006.01)
*H01H 50/14* (2006.01)
(Continued)

(52) U.S. Cl.
CPC ..... *H01H 50/14* (2013.01); *H01H 50/02* (2013.01); *H01H 50/045* (2013.01); *H01H 50/443* (2013.01); *H01H 51/005* (2013.01)

(58) Field of Classification Search
CPC ..... H01H 50/04; H01H 50/54–50/62; H01H 2050/048; H01H 50/00; H01H 50/002;
(Continued)

(56) References Cited

U.S. PATENT DOCUMENTS 5,606,299 A * 2/1997 Innes ..... H01H 50/021 335/132
5,652,420 A 7/1997 Innes et al.
(Continued)

FOREIGN PATENT DOCUMENTS

EP 0 774 768 A1 5/1997
FR 1360246 A 5/1964
(Continued)

OTHER PUBLICATIONS

International Search Report issued Feb. 24, 2015 in PCT/EP2014/076865.

*Primary Examiner* — Shawki S Ismail
*Assistant Examiner* — Lisa Homza
(74) *Attorney, Agent, or Firm* — Oblon, McClelland, Maier & Neustadt, L.L.P.

(57) ABSTRACT

An electrical switching device including an electric power switching module including a block of three input terminals and three output terminals, each input or output terminal being connected to a stationary contact of an electrical switch also including a mobile contact, configured to switch between an open position and a closed position, the mobile contact configured to be moved by an electromagnetic drive mechanism, and a control module, including at least one control input terminal and at least one control output terminal. The control module includes the electromagnetic drive mechanism configured to be supplied by the control terminals to control a position of one of the mobile contacts. A supervision module includes an auxiliary input contact terminal and two auxiliary output contact terminals, the aux-
(Continued)

iliary input contact terminal being shared by the two auxiliary output contact terminals, the power module being removable separately from the control and supervision modules.

7 Claims, 4 Drawing Sheets

(51) Int. Cl.
*H01H 50/04* (2006.01)
*H01H 51/00* (2006.01)
*H01H 50/02* (2006.01)
*H01H 50/44* (2006.01)

(58) Field of Classification Search
CPC ..... H01H 50/02; H01H 50/14; H01H 50/16; H01H 50/1854; H01H 50/64; H01H 50/443; H01H 71/0271; H01H 71/9126
USPC ..... 335/102
See application file for complete search history.

(56) References Cited

U.S. PATENT DOCUMENTS 6,411,184 B1 * 6/2002 Comtois ..... H01H 50/042 335/106
7,973,625 B2 * 7/2011 Chandrappa ..... H01H 50/541 200/243
2002/0130742 A1 9/2002 Jacq et al.
2002/0175788 A1 11/2002 Comtois et al.
2003/0001700 A1 * 1/2003 Comtois ..... H01H 50/045 335/9
2007/0128921 A1 * 6/2007 Gerving ..... H01H 50/045 439/493
2013/0140153 A1 * 6/2013 Larcher ..... H01H 9/26 200/50.32
2014/0284310 A1 * 9/2014 Gerving ..... H01H 9/36 218/26
2015/0137915 A1 * 5/2015 Mills ..... H01H 71/12 335/11
2015/0318133 A1 * 11/2015 Lauraire ..... H01H 50/002 335/185
2015/0325397 A1 * 11/2015 Larcher ..... H01H 50/002 335/187
2016/0196911 A1 * 7/2016 Comtois ..... H01F 7/081 335/256

FOREIGN PATENT DOCUMENTS

FR 2 697 371 A1 4/1994
FR 2 818 435 A1 6/2002
FR 2 983 633 A1 6/2013

* cited by examiner

ELECTRICAL SWITCHING DEVICE

The present invention relates to an electrical switching device of the type comprising an electrical power switching module and a control module.

It lies within the field of switching devices capable of providing contact, interruption and electrical switching functions between conductors.

These devices are used in numerous ways for the connection, interruption and inversion of electrical power current, notably for the control of electric motors, heating resistances or power circuits in general.

For example, one electrical switching device of this type is a three-phase inverter suitable for connection between an electric motor and a motor supply system, to enable two phases of a three-phase supply current of the electric motor to be crossed over in order to reverse the direction of rotation of the motor.

There are known switching devices comprising power contact terminals, control terminals being used to control an electromagnetic drive device, and auxiliary contact terminals being used for the purpose of monitoring the operation.

For example, patent application FR2697371 describes a contactor device composed of a contact block formed by a casing containing fixed contacts linked to connecting terminals. The set of connecting terminals for making power contacts, control contacts and auxiliary monitoring contacts is located on the front face of the casing.

The device comprises a movable contact carrier equipped with contact bridges interacting with the fixed contacts so as to form a set of power poles, the contact holder being actuated by means of an electromagnet. The maintenance of a contactor device of this type is complicated, since the casing has to be completely removed in order to access the contact bridge.

The patent application FR2983633 describes an electrical switching device comprising a power module having six power contact terminals, including three input contact terminals and three output contact terminals, and, on either side of the power module, two control contact terminals. This electrical switching device is placed in a casing. However, this electrical switching device has no auxiliary contact terminals for the purpose of monitoring operation. The addition of a monitoring module having auxiliary contact terminals would increase the overall dimensions of the electrical switching device.

However, for many applications it is advantageous to have a switching device with the smallest possible overall dimensions.

The object of the invention is to propose an electrical switching device of the aforesaid type which overcomes the aforementioned drawbacks of the known solutions by incorporating auxiliary contact terminals while allowing easier maintenance.

For this purpose, the invention proposes, according to a first aspect, an electrical switching device comprising:

- an electrical power switching module, said electrical power switching module comprising a block of three input terminals and three output terminals, each input or output terminal being connected to a fixed contact of an electrical switch, which also comprises a movable contact and can switch between an open position and a closed position according to the positioning of the movable contact relative to the fixed contact, an aforesaid movable contact being capable of being moved by an electromagnetic drive device,

- and a control module comprising a set of control terminals formed by at least one control input terminal and at least one control output terminal, the control module comprising said electromagnetic drive device which can be supplied by said control terminals to control a position of one of said movable contacts.

The electrical switching device according to the invention further comprises a monitoring module comprising an auxiliary input contact terminal and two auxiliary output contact terminals, said auxiliary input contact terminal being common to the two auxiliary output contact terminals, said power module being detachable separately from the control module and the monitoring module.

Advantageously, the proposed switching device comprises a power contact module, a control module and a monitoring module, the power contact module being removable. Thus the maintenance of this switching device is improved, the replacement of the power module being made easier than in the previously known devices.

Additionally, and advantageously, the use of a common input contact terminal for two output contact terminals, in the monitoring module and in the control module respectively, makes it possible to produce a switching device with smaller overall dimensions.

The switching device according to the invention may also have one or more of the following characteristics:

- the set of control terminals and the set of monitoring terminals are mounted on either side of the terminal block of the electrical power switching module;
- the switching device is placed in a casing, and the set of control terminals, the set of monitoring terminals, and the terminal block of the electrical power switching module are mounted on the front face of said casing;
- each of said set of control terminals, set of monitoring terminals and terminal block of the electrical power switching module is protected by a protective cover having a visual distinguishing sign;
- said electromagnetic drive device comprises two electromagnetic coils, and the control module comprises a common input control terminal capable of supplying said electromagnetic coils;
- the switching device comprises two electrical coupling elements capable of forming, respectively, a fixed input control contact of a first electromagnetic coil and a fixed input control contact of a second electromagnetic coil, and it comprises a connecting element comprising two connection apertures, adapted to interact with said electrical coupling elements, and to form a common input contact terminal for supplying power to said first and second electromagnetic coils;
- the monitoring module comprises two switches, each switch being capable of switching between an open position and a closed position, each switch comprising a fixed input contact connected to said common auxiliary input contact terminal, and a fixed output contact connected to an aforesaid auxiliary output contact terminal, said fixed input contact and a fixed output contact being capable of being electrically connected by a movable contact held by a movable contact blade, said movable contact blade being fixed in a support element which can be moved by an electromagnetic drive device.

Other characteristics and advantages of the invention will be apparent from the description given below, for illustrative purposes and in an entirely non-limiting way, with reference to the attached drawings, of which:

Figure 1:
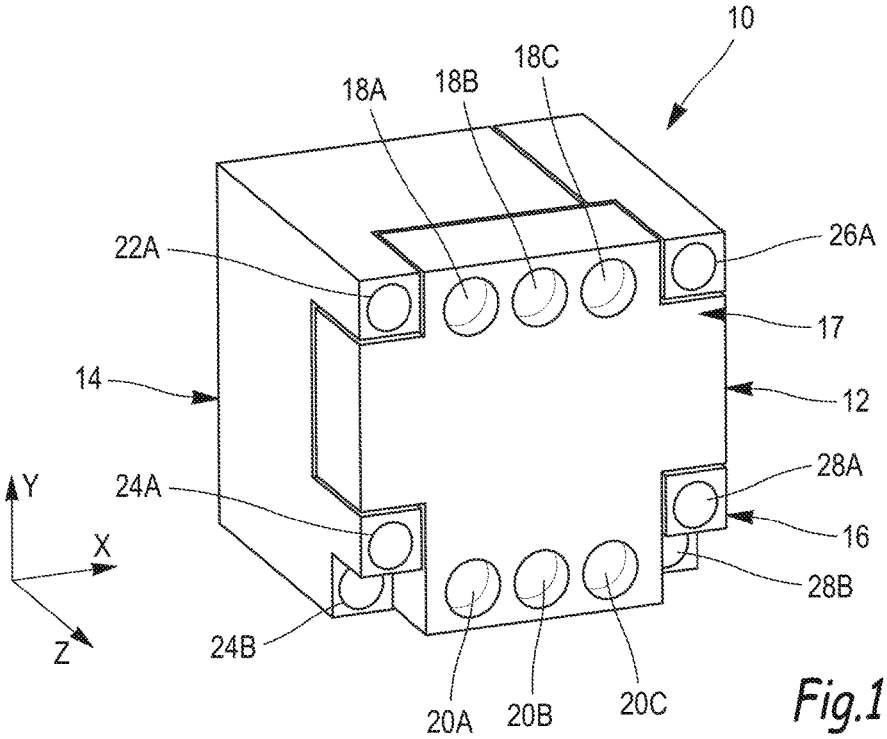
FIG. 1 shows a perspective view of a contactor-breaker device according to the invention.

The switching device 10 shown in FIG. 1 comprises three modules, namely an electrical power switching module 12, a control module 14 and a monitoring module 16.

Each of the modules comprises a plurality of contact terminals, located on the same face 17, called the front face, of the switching device 10.

The electrical power switching module 12 is located on the front of the control module 14 and comprises a set of six power contact terminals, hereinafter simply referred to as "terminals", namely a first 18A, a second 18B and a third 18C input terminal and a first 20A, a second 20B and a third 20C output terminal for use in a three-phase current network.

The control module 14 comprises, on the same face 17 of the switching device 10, a set of three control terminals, namely an input control terminal 22A and a first 24A and a second 24B output control terminal.

The control module 14 comprises an electromagnetic drive device (not visible in FIG. 1) which can be supplied by said control terminals to control an operating position of the switching device 10. In the embodiment, the electromagnetic drive device is an electromagnetic actuator with two coils.

Preferably, an electromagnetic actuator such as that described in patent application FR1360246 is used.

The first output control terminal 24A is located in the same depth plane as the input terminals 18A, 18B, 18C and output terminals 20A, 20B, 20C, while the second output control terminal 24B is set back from said depth plane.

The control module 16 comprises, on the same face 17 of the switching device 10, a set of three auxiliary control terminals, namely an auxiliary input contact terminal 26A and a first 28A and a second 28B auxiliary output control terminal.

In a similar way to the terminals of the control module 14, the first auxiliary output contact terminal 28A is located in the same depth plane as the input terminals 18A, 18B, 18C and output terminals 20A, 20B, 20C, while the second auxiliary output contact terminal 28B is set back from said depth plane.

The various contact terminals are also offset vertically, that is to say along the Y axis of the associated reference frame, shown in FIG. 1. The input terminals 18A, 18B, 18C are located slightly below the respective control input terminal 22A and auxiliary contact input terminal 26A. The output terminals 20A, 20B, 20C are located substantially above the second control terminal 24B and auxiliary contact terminal 28B, and substantially below the first control terminal 24A and auxiliary contact terminal 28A along the vertical axis.

Thus the overall dimensions of the switching device 10 are substantially identical to the overall dimensions of a device of the same type which has only ten contact terminals on its front face.

The switching device 10 forms a compact block, the dimensions of its front face preferably being about 45 mm×45 mm (millimeters).

Advantageously, the electrical power switching module 12, the control module 14 and the monitoring module 16 are separable, the electrical power switching module 12 being removable, and therefore detachable, from the front of the switching device 10. Thus the electrical power switching module 12 is easy to handle, and its replacement in case of wear or faults is facilitated.

Advantageously, the sets of terminals of the control module 14, on the one hand, and of the monitoring module 16, on the other hand, are positioned on either side of the set of terminals of the electrical power switching module 12, so as to facilitate wiring.

Preferably, each of the electrical power switching module 12, the control module 14 and the monitoring module 16 comprises a protective cover which is visually distinctive, because of its color for example, so as to make the wiring and maintenance of the switching device even easier. More generally, other visual distinguishing signs are used for the protective covers, making it easy to distinguish between the modules.

Figure 2:
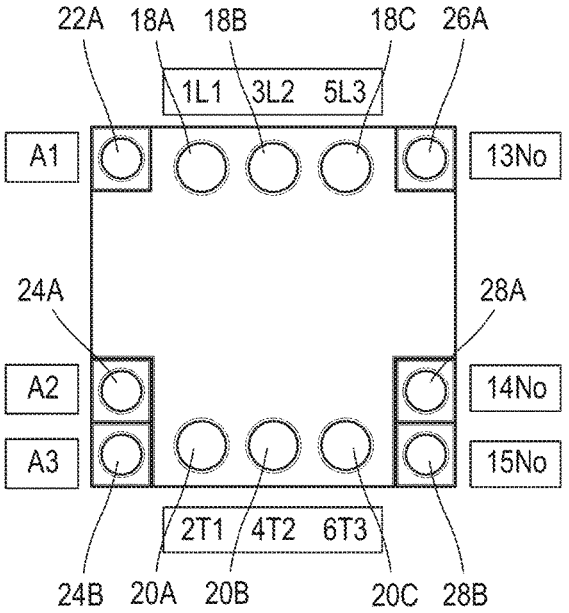
FIG. 2 shows a schematic front view of the connecting terminals of a contactor-breaker device according to the invention.
Figure 3:
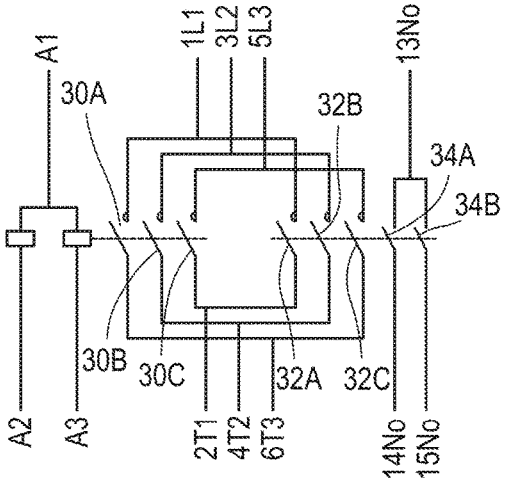
FIG. 3 is a schematic diagram of the operation of a contactor-breaker device according to FIG. 2.

FIG. 2 shows a schematic view of the contact terminals of the electrical power switching module 12, the control module 14 and the monitoring module 16, and FIG. 3 shows the associated schematic diagram of electrical operation.

The control terminals 22A, 24A, 24B are connected to contacts denoted A1, A2, A3 respectively on the schematic diagram of FIG. 3, making it possible to control the direction of the electric current flowing through the two coils of the electromagnetic actuator of the control module. The two coils are supplied by a common input contact A1.

The first 18A, second 18B and third 18C input terminals of the electrical power switching module 12 are connected to the contacts denoted 1L1, 3L2, 5L3 in FIGS. 2 and 3, and the first 20A, second 20B and third 20C output terminals of the electrical power switching module 12 are connected to the contacts denoted 2T1, 4T2, 6T3 in FIGS. 2 and 3.

The power switching module 12 performs electrical contact and electrical switching functions between phase conductors, as shown schematically in FIG. 3 by a set of three first electrical switches 30A, 30B, 30C and three second electrical switches 32A, 32B, 32C, each electrical switch 30A, 30B, 30C, 32A, 32B, 32C being capable of switching between an open position and a closed position. This configuration of switches makes it possible, on the one hand, to perform the contactor/switch function for each power phase, and, on the other hand, to carry out switching between power phases.

The auxiliary contact terminals 26A, 28A, 28B of the monitoring module 16 are connected to contacts denoted 13No, 14No, 15No respectively on the schematic diagram of FIG. 3. The corresponding schematic diagram of operation comprises two switches 34A, 34B, shown in the open position, a position conventionally called "NO" for "normally open", having a common auxiliary input contact 13No.

In the example, the switches are all shown in the normally open (NO) position, but evidently, in variants, any configurations, including normally open switches and normally closed switches, would be feasible.

Figure 4:
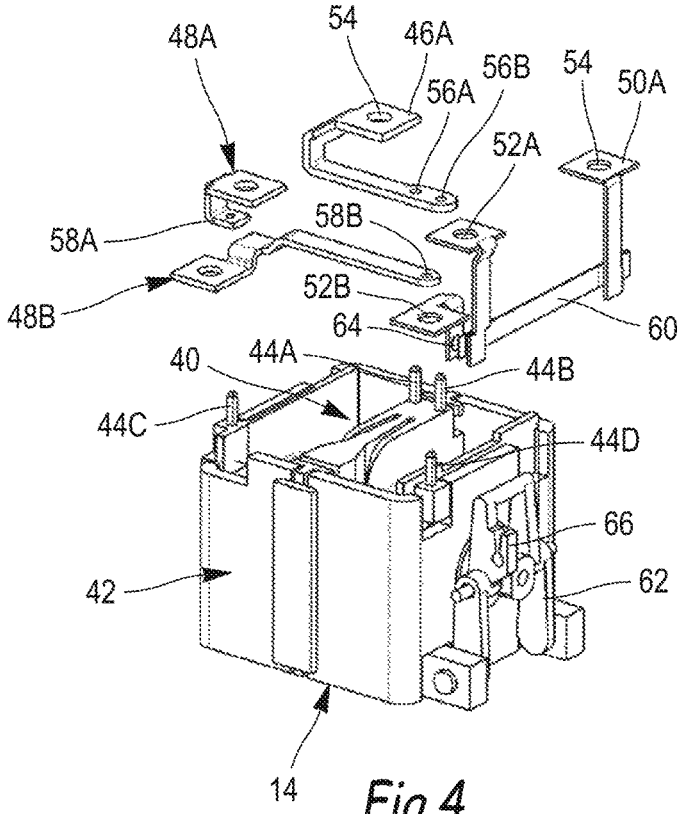
FIG. 4 is an exploded perspective view of the control module and of the connecting elements which can be used to form control terminals and auxiliary contact terminals according to one embodiment.
Figure 5:
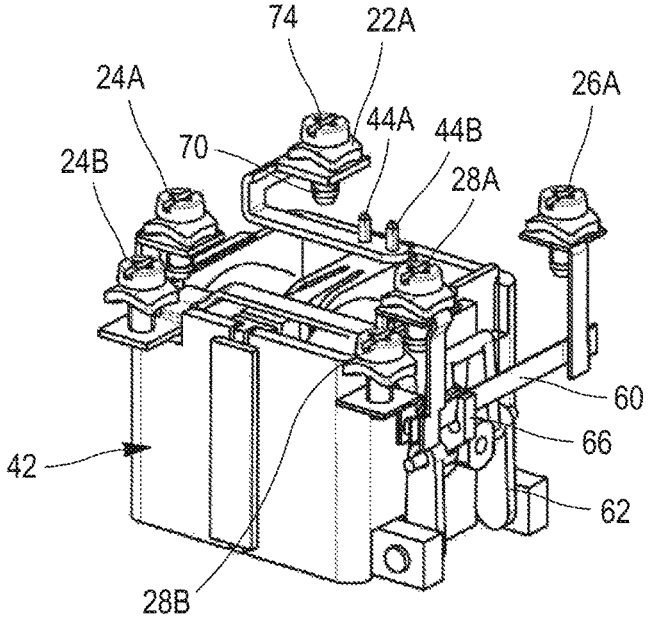
FIG. 5 is a perspective view of the elements of FIG. 4 assembled together.

FIGS. 4 and 5 show an embodiment of an electrical switching device according to the invention.

An electromagnetic actuator 40 with two coils is placed in a casing 42 of a control module 14.

Electrical coupling elements 44A, 44B, 44C and 44D are present in the form of projections, the coupling elements 44A, 44B being capable of providing, respectively, a fixed input control contact of the first coil and a fixed input control contact of the second coil, and the coupling elements 44C, 44D being capable of providing a first and a second fixed output control contact.

Connecting elements 46A, 48A, 48B, 50A, 52A, 52B, providing control and monitoring contact terminals for the connection of wires (not shown), are also illustrated in FIG. 4. Each connecting element comprises an aperture 54 for the passage of the shank of a screw of a screw and nut assembly.

The connecting element 46A further comprises two connecting apertures 56A, 56B adapted to interact with the coupling elements 44A, 44B, and to provide a common input contact terminal for the supply of the two coils of the electromagnetic actuator 40.

The connecting element 48A comprises a connection aperture 58A adapted to interact with the coupling element 44C, and the connecting element 48B comprises a connection aperture 58B adapted to interact with the coupling element 44D.

Thus the connecting elements 46A, 48A, 48B are associated with the input control terminal 22A and the output control terminals 24A, 24B.

The connecting elements 50A, 52A, 52B, having apertures 54 for the passage of screw shanks, correspond to the auxiliary contact terminals 26A, 28A and 28B.

These connecting elements are linked by a movable contact blade 60 which can be moved to establish or interrupt the flow of electric current by the actuation of a lever 62.

Each auxiliary contact is formed by a fixed auxiliary contact 64 and a movable auxiliary contact associated with the movable contact blade 60.

The lever 62 is actuated by the flow of current in the respective coils of the electromagnetic actuator, and is adapted to assume three positions, corresponding to the states of the coils called "forward", "reverse", and "neutral or OFF".

The movable contact blade 60 can be fitted into a support element 66 which is mechanically connected to the lever 62 and is made to move by this lever.

FIG. 5 shows the control module 14 after the fastening of the connecting elements 46A, 48A, 48B, 50A, 52A, 52B, and the screw 70 and nut 74 assemblies for connecting external electrical wires to the respective contact terminals 22A, 24A, 24B, 26A, 28A, 28B.

Figure 6:
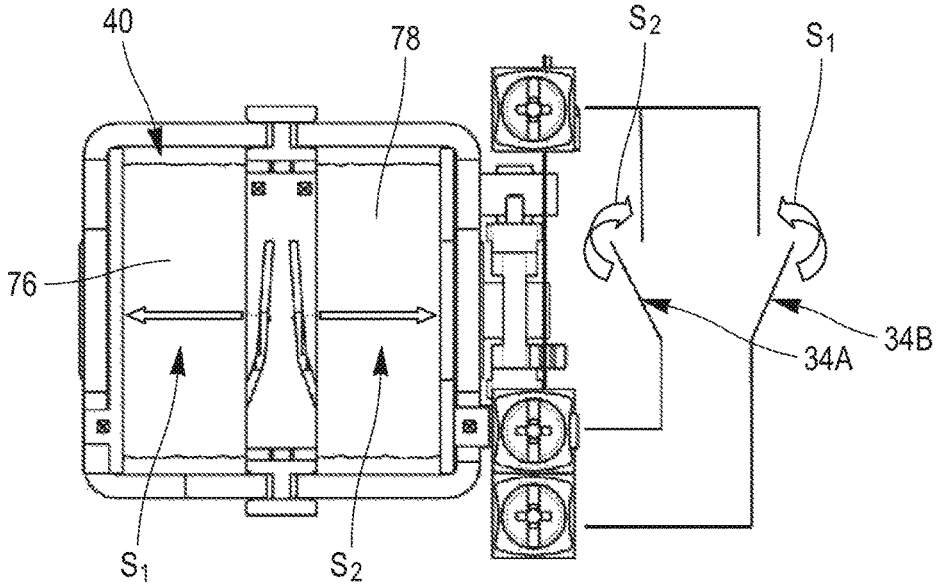
FIG. 6 is a schematic sectional view illustrating the operation of the auxiliary contacts linked to the control module.

FIG. 6 shows schematically the operation of the switches 34A, 34B corresponding to the auxiliary contacts, based on the direction of the electric current in the electromagnetic coils 76, 78 of the electromagnetic actuator 40.

The first current direction, denoted S1 in the drawing, causes the movable contact blade 60 to move so as to close the switch 34A, while the current direction denoted S2 in the drawing causes the movable contact blade 60 to move so as to close the switch 34B.

Figure 7:
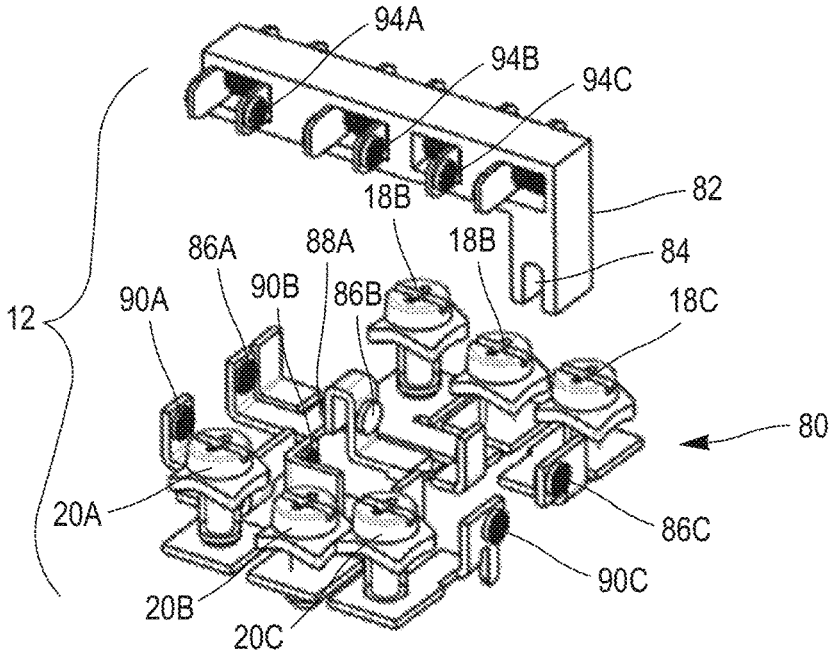
FIG. 7 is a perspective view of power contact terminals and of the associated movable contact holder.

FIG. 7 shows a power contact block 80 forming part of the electrical power switching module 12, and a movable contact holder 82, capable of forming, with the power contact block 80, the electrical power switching module 12.

Figure 8:
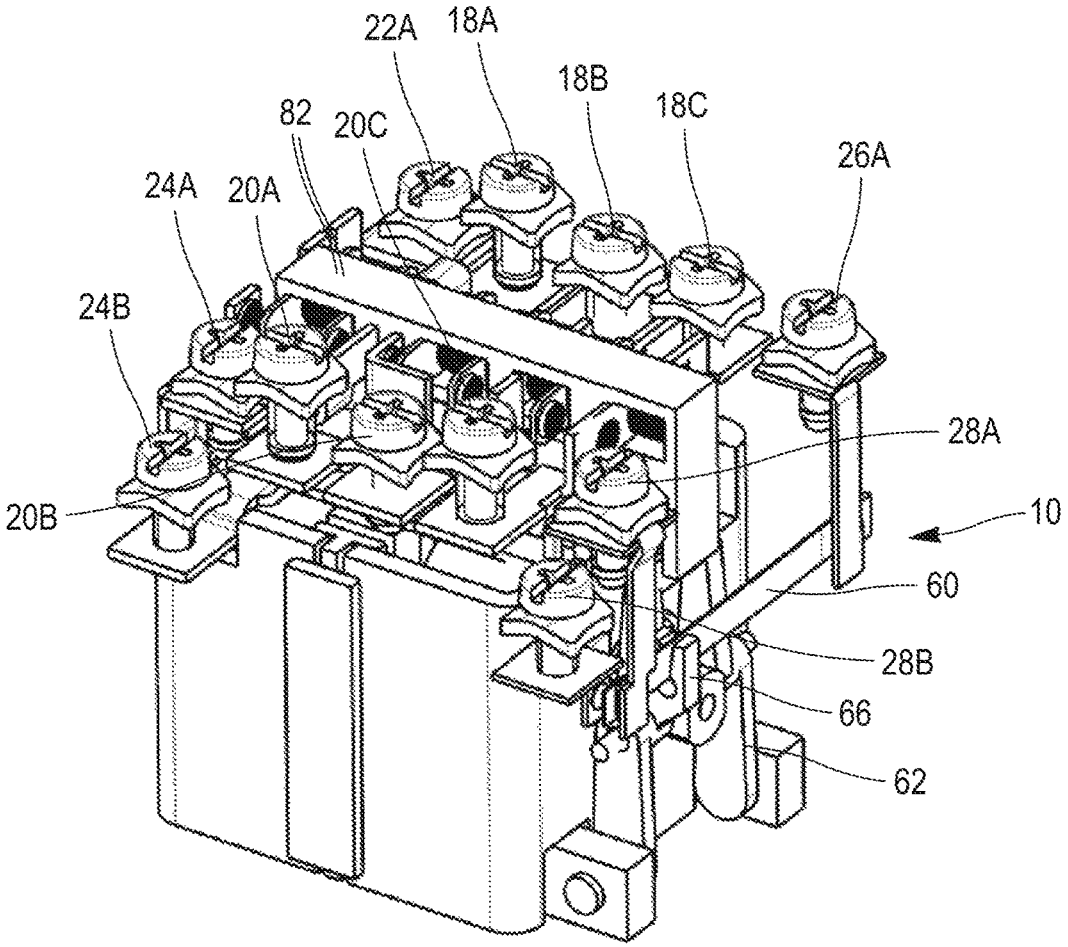
FIG. 8 is a perspective view of the contact terminals of a switching device according to the invention.

When the assembly of the elements of the electrical power switching module 12 is completed, the result is an electrical switching device 10 as shown in FIG. 8. In this figure, the device 10 is shown without the separating covers of the sets of control terminals, power terminals and monitoring terminals.

The movable contact holder 82 comprises a fastening element 84 which can be positioned on a support element linked mechanically to the lever 62.

The power contact block 80 comprises first fixed input contacts 86A, 86B, 86C, second fixed input contacts 88A, 88B, 880, first fixed output contacts 90A, 90B, 90C, and second fixed output contacts 92A, 92B, 92C.

The first input contact terminal 18A is electrically connected to the first fixed input contact 86A and to the second fixed input contact 88A, and the first output terminal 20A is electrically connected to the first fixed output contact 90A and to the second fixed output contact 92A.

The same applies to the second and third input contact terminals 18B, 18C and output contact terminals 20B, 20C.

The movable contact holder 82 comprises movable contacts 94A, 94B, 94C which can be moved in translation by the lever 62 driven by the electromagnetic actuator.

Thus, when the movable contact holder 82 is positioned as shown in FIG. 8 facing respective fixed contacts, the movement of the movable contacts can create connection or isolation between respective fixed contacts.

The invention claimed is:

1. An electrical switching device comprising:

an electrical power switching module, comprising a terminal block of three input terminals and three output terminals, each input or output terminal being connected to a fixed contact of an electrical switch, which also comprises a movable contact configured to switch between an open position and a closed position according to a positioning of the movable contact relative to the fixed contact, the movable contact configured to be moved by an electromagnetic drive device;

a control module comprising a set of control terminals including at least one control input terminal and at least one control output terminal, the control module comprising the electromagnetic drive device which can be supplied by the control terminals to control a position of one of the movable contacts;

a monitoring module comprising an auxiliary input contact terminal and two auxiliary output contact terminals, the auxiliary input contact terminal being common to the two auxiliary output contact terminals; and the power module being detachable separately from the control module and monitoring module.

2. The switching device as claimed in claim 1, wherein the set of control terminals and a set of monitoring terminals including the auxiliary input and output contact terminals are mounted on either side of the terminal block of the electrical power switching module.

3. The switching device as claimed in claim 2, placed in a casing and wherein the set of control terminals, the set of monitoring terminals, and the block of terminals of the electrical power switching module are mounted on a front face of the casing.

4. The switching device as claimed in claim 3, wherein each of the set of control terminals, set of monitoring terminals, and terminal block of the electrical power switching module is protected by a protective cover having a visual distinguishing sign.

5. The switching device as claimed in claim 1, wherein the electromagnetic drive device comprises two electromagnetic coils, and the control module comprises a common input control terminal configured to supply the electromagnetic coils.

6. The switching device as claimed in claim 5, comprising two electrical coupling elements configured to form, respectively, a fixed input control contact of a first electromagnetic coil and a fixed input control contact of a second electromagnetic coil, and comprising a connecting element comprising two connection apertures, configured to interact with the electrical coupling elements, and to form a common input contact terminal for supplying power to the first and second electromagnetic coils.

7. The switching device as claimed in claim 1, wherein the monitoring module comprises two switches, each switch configured to switch between an open position and a closed position, each switch comprising a fixed input contact connected to the common auxiliary input contact terminal, and a fixed output contact connected to one of the auxiliary output contact terminals, the fixed input contact and a fixed output contact configured to be electrically connected by a movable contact held by a movable contact blade, the movable contact blade being fixed in a support element which is configured to be moved by an electromagnetic drive device.

* * * * *